US005409173A

United States Patent [19]

Fahmuller et al.

[11] Patent Number: 5,409,173

[45] Date of Patent: Apr. 25, 1995

[54] WINDING DEVICE WITH A CONTROL DEVICE FOR THE CONTROL OF THE CONTACT PRESSURE OF A BOBBIN AGAINST A DRIVE ROLLER

[75] Inventors: Maximilian Fahmuller, Kelheim; Thomas-Georg Meier, Wettstetten, both of Germany

[73] Assignee: Rieter Ingolstadt Spinnereimaschinenbau AG, Ingolstadt, Germany

[21] Appl. No.: 984,569

[22] PCT Filed: Jul. 1, 1992

[86] PCT No.: PCT/EP92/01485

§ 371 Date: Jun. 17, 1993

§ 102(e) Date: Jun. 17, 1993

[87] PCT Pub. No.: WO93/01119

PCT Pub. Date: Jan. 21, 1993

[30] Foreign Application Priority Data

Jan. 7, 1991 [DE] Germany ..... 41 21 775.6

[51] Int. Cl.[6] ..... B65H 67/044; B65H 18/22

[52] U.S. Cl. ..... 242/18; 242/541.6

[58] Field of Search ..... 242/18 DD, 18 B, 65, 242/18 R, 541.4, 541.5, 541.6, 541.7

[56] References Cited

U.S. PATENT DOCUMENTS

| | | | |
|---|---|---|---|
| 2,196,000 | 4/1940 | Richardson . | |
| 3,430,875 | 3/1969 | Kieronski . | |
| 3,845,911 | 11/1974 | Wyatt . | |
| 3,991,950 | 11/1976 | Tashiro et al. | 242/18 DD |
| 4,102,506 | 7/1978 | Raasch et al. . | |
| 4,140,286 | 2/1979 | Lattion | 242/18 DD |
| 4,342,429 | 8/1982 | Katoh et al. . | |

FOREIGN PATENT DOCUMENTS

| | | |
|---|---|---|
| 1117295 | 6/1962 | Germany . |
| 2220727 | 11/1973 | Germany . |
| 3911854A1 | 11/1989 | Germany . |
| 3913793A1 | 11/1989 | Germany . |
| 1349425 | 4/1974 | United Kingdom . |
| 1460466 | 1/1977 | United Kingdom . |

*Primary Examiner*—John M. Jillions
*Assistant Examiner*—Michael R. Mansen
*Attorney, Agent, or Firm*—Dority & Manning

[57] ABSTRACT

A winding device is provided with a device for the production of contact pressure of the bobbin against the drive roller. The device includes an additional pressure mechanism in the form of a pneumatic cylinder which does not reverse its torque exerted upon the bobbin holder to produce an additional contact pressure during bobbin build-up is provided.

7 Claims, 3 Drawing Sheets

WINDING DEVICE WITH A CONTROL DEVICE FOR THE CONTROL OF THE CONTACT PRESSURE OF A BOBBIN AGAINST A DRIVE ROLLER

BACKGROUND OF THE INVENTION

The instant invention relates to a winding device, and more particularly to a control device for controlling the contact pressure of a bobbin against its drive roller.

The winding of a delivered yarn into cross-wound bobbins on a variety of textile machines is known from the state of the art. This operation can, for instance, take place in winding machines and spinning/winding machines, e.g. rotor spinning machines. For this purpose, the winding device is as a rule equipped with a bobbin arm to hold and guide the bobbin. To drive the bobbin it is presented to a rotating roller which rotates the bobbin through friction. During the build-up of the bobbin, which is accompanied by an increase of bobbin diameter, the bobbin arm evens out the increasing bobbin diameter through a swivelling motion in such a manner that the bobbin is in contact with the roller at approximately the same location throughout the build-up.

A winding and bobbin holder is known from DE-OS 11 17 295, whereby the contact pressure of the bobbin against a roller which drives it is controlled by means of an adjustable spring. With this device, the pressure on the bobbin which is caused by gravity is at first increased as the bobbin is built up and is later lowered by means of a drive spring. The bobbin arm is here provided with a lever which supports the bobbin at one end as part of a rocking lever joint arrangement, while it is subjected at its other end to the force of a spring. During the build-up of the bobbin the rocking lever joint goes through its extended position, whereby the spring exerts force producing a pressure upon the bobbin. During further build-up of the bobbin, the rocking lever joint leaves its extended position again, so that the spring is now exerting a lifting force upon the bobbin arm. The spring force which decreases due to the extension of the spring is thereby more than compensated for by a longer lever arm upon which the spring acts. The purpose of this arrangement is to keep the contact pressure of the bobbin against the drive roller approximately constant during the entire build-up of said bobbin. Through suitable selection of the appropriate length of the rocking lever joint, it is also possible to decrease the contact pressure of the bobbin against the drive roller as the bobbin diameter increases. Depending on the application of the completed bobbin, it may be desired that the bobbin be wound with different contact pressures, e.g. with less contact pressure for dye bobbins. For other applications, it may be desired that the bobbin be wound tightly. For this purpose the spring of the winding mechanism of DE-OS 22 17 295 is provided with an adjusting screw by means of which the pre-stress of the spring can be changed. DE 25 18 646 C2 discloses a device for the control of the contact pressure of a textile bobbin in which the extension position of the rocker lever arrangement, as well as the pre-stress of the pressure spring, can be changed.

DE-OS 22 20 727 discloses a device to produce the contact pressure for bobbins in which one or two springs are intermittently assigned to a pressure device during the build-up of the bobbin. Here, too, an adjustability of pre-stress of the pressure spring, as well as a change of the lever arm on which the Spring acts, occurring simultaneously with the adjustment of spring force, is already shown.

DE 39 11 854 A1 discloses a control device for the contact pressure of a bobbin in which the bobbin arm supporting the bobbin attaches by means of a pneumatic cylinder. In this device an optimal contact pressure is determined as a function of the diameter of the bobbin, whereby the contact pressure control device maintains a pre-set contact pressure correction curve, whereby a drive mechanism of the bobbin holder is controlled via the momentary bobbin diameter. For this purpose the ratio of the bobbin's speed of rotation and that of the drive roller is detected to calculate the take-up bobbin diameter and the driving mechanism of the bobbin arm is controlled on the basis of the indicated attribution of diameter and contact pressure.

DE 24 06 122 C2 shows a wind-up device of a winding machine in which the device used to press the bobbin against the drive roller is equipped with two compression springs by means of which a resulting force is finally exerted upon the rocking lever joint arrangement, whereby the bobbin is first pressed against the drive roller and is lifted up in opposition to gravity as the bobbin diameter increases. The utilization of two springs is intended to exponentially decrease the contact pressure between bobbin and drive roller as the bobbin grows.

With ever higher standards demanded in the quality of yarns, and especially of the bobbins constituted therewith, and above all so as to satisfy the demand for greater flexibility and ease in operation, especially in spinning/winding machines, new concepts are needed in order to achieve and, at the same time, to improve results under different conditions and requirements. The change-over of spinning-winding machines to other yarn numbers or other fiber materials, as well as the requirements imposed on controllability and adjustability of the machines which are becoming more and more important in improving quality, require new concepts in solving new resulting problems. Development should also make it possible for producing different yarns on a machine, whereby it is necessary for said yarns to be wound up accordingly. This has become possible by marking each individual bobbin, because there is then no longer any danger of mixing up the different yarns. In addition, it will be required in the future in a winding mechanism that the winding conditions, i.e. the contact pressure of the bobbin, can be adapted automatically and rapidly as a function of the momentary operating situation, e.g. during piecing, after yarn breakage, when starting the yarn on the former, or during the formation of a yarn reserve. The solutions provided by the state of the art so far are no longer able to meet such new requirements.

The device of DE 25 18 646 C2, for example, has the disadvantage that only a small number of spinning stations can be adjusted simultaneously by means of its adjusting mechanism. In the spinning/winding machines normally used today, and which may have about 280 spinning stations, this device can only be used at great cost. In addition it has the disadvantage that due to the mechanical clearance, the adjusting mechanism can produce different forces at different winding stations, so that the winding of the bobbins varies from spinning station to spinning station. In addition, the adjustment of the contact pressure takes time and requires trained personnel. A change in the adjustment during operation is practically impossible, and the change cannot be automated.

The control device of DE 39 11 854 A1 requires great expenditures for the detection of the different rotational speeds as well as a costly and complicated device to control the contact pressure mechanism.

Although the devices shown otherwise in the state of the art serve their purpose in part in their special application, they are however entirely inflexible. As a result, high costs are involved when a different fiber material or a different bobbin density is to be wound, for example, or when it appears during the operation of the machine that the contact pressure must be increased or lowered.

OBJECTS AND SUMMARY OF THE INVENTION

It is a principal object of the instant invention to improve the state of the art in the sense of creating a simple, low-cost, space-saving and flexible winding device which avoids the disadvantages of the state of the art and which makes it also possible to automate the adjustment of the contact pressure of a bobbin and in which the contact pressure of individual winding stations or groups of winding stations can also be variably adjusted.

Additional objects and advantages of the invention will be set forth in part in the description which follows, and will in part be obvious from the description, or may be learned by practice of the invention.

The objects are attained through embodiments of the present invention. By using a pressure means which first presses the bobbin upon the drive roller and which later lifts up from the bobbin as the mass of the bobbin increases in order to avoid excessive contact pressure, the goal of providing an advantageous basic pressure on the bobbin by means of a simple and low-cost, as well as space-saving device, is achieved. By furthermore providing a pressure cylinder, the predetermined contact pressure of the bobbin can be changed in a simple manner so that a bobbin holder with flexible application is created which is able to modify the contact pressure predetermined by the pressure means easily and over a wide range. The placement of the pressure cylinder on the lever arm of the bobbin holder in such a manner that the exerted torque does not oppose its rotating effect on the bobbin holder during the entire bobbin build-up is achieved in that the level of the contact pressure is modified in uniform direction throughout the entire bobbin build-up. This means that the pressure is either increased or lowered throughout the entire bobbin build-up. The utilization of a pressure cylinder makes it possible for this modification of the contact pressure to be effected by simple means on all winding stations of a spinning or winding machine. The possibility of subjecting all the bobbin holders of a machine to the same medium pressure causes the bobbins at all winding stations to be wound with the same contact pressure. The medium pressure can easily be kept constant. Any desired number of winding stations in a machine can thereby be operated with the same contact pressure between the bobbin and the drive roller. It is especially advantageous for the torque exerted by the pressure cylinder to increase the contact pressure of the bobbin. This makes it possible for the pressure means to be designed with merely the minimum force corresponding to the lowest contact pressure, so that it can be made at very low cost and be kept small. Additionally, the required contact pressure can be set by simple means by the pressure cylinder. In another advantageous embodiment of the invention, the drive force of the bobbin is reduced by the pressure cylinder. Thereby it is possible to operate with low, energy-saving air pressures, for instance when operation is substantially with high contact pressure at the winding stations of a machine.

The bobbin holder becomes especially flexible if the pressure cylinder is provided with a piston which can be subjected to pressure on both sides. This makes it possible for the basic pressure on the bobbin holder to be increased as well as decreased. It is especially advantageous for the pressure cylinder to be connected to a supply circuit which already subjects it to a pre-set pressure. This makes it possible to set and maintain a constant pressure at all winding stations. The supply circuit has the great advantage that it can be made flexible, so that no special measures must be taken in designing the entire machine.

It is especially advantageous for the pressure cylinder to be connected via a valve to a second supply circuit, and it is thus possible to apply a different medium pressure to individual winding stations or groups of winding stations than to the other winding stations during the operation of the spinning or winding machine. This is especially advantageous when the two supply circuits are operated at different, predetermined pressures. In addition, it is also possible to subject one single winding station with a different pressure in order to achieve a different contact pressure while it is operated in a given operating situation. This method, for instance, be used in starting a yarn on a former or during acceleration of a bobbin following a yarn breakage. For this, the operator or the automatic service unit can control the connection of the piston to a particular supply circuit. As a result, special pressure means which have in the past been installed in the automatic service unit, can be omitted. Thanks to the two supply circuits with different pressures, the desired different pressures are available at all times. It is especially advantageous with this embodiment that the pressure is kept substantially constant at the desired level via a pressure control device. Thanks to the adjustability of the pressure in each individual supply circuit, the desired pressure can be produced precisely and this pressure can also be modified during the operation of the machine. With this embodiment, the adjustment of the pressure can also be automatic, if a device is provided on the spinning/winding machine by means of which the machine can control the correct draft by using stored desired yarn parameters. This device can also be used to set the corresponding contact pressure of the bobbin automatically. It is especially advantageous if the pressure cylinder is assigned a controllable valve by means of which it can be separated from the supply circuit or can be connected to one or the other supply circuit. It is especially advantageous if the pressure cylinder can be uncoupled from the supply circuit when no force that would change the contact pressure of the bobbin is desired on a permanent or temporary basis. It is advantageous in that case if a valve assigned to the pressure cylinder can be operated from the control device of the spinning/winding machine. This makes it possible for the device to be automated. To change the direction of the piston of the cylinder, it is advantageous to provide a valve which alternatively connects either the forward or the rear end of the piston to a supply circuit. In an especially advantageous embodiment, this valve is controlled automatically by the machine. If necessary, it is also advantageous if the pressure force on the piston can be changed individually at the winding station, e.g. during piecing or after yarn breakage.

For uniform and undisturbed bobbin build-up it is especially advantageous if the piston of the pressure cylinder acts at the same time as a friction damper. Thereby the oscillation of the bobbin during bobbin build-up can be damped, so that an additional damper on the bobbin holder can even be omitted under favorable circumstances.

The invention is described below through drawings which are incorporated in and constitute a part of this specification, and which illustrate embodiments of the invention.

DESCRIPTION OF THE PREFERRED EMBODIMENTS

Reference will now be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications are variations can be made in the present invention without departing from the scope or spirit of the invention. The numbering of components is consistent throughout the application, with the same components having the same number in each of the drawings.

Figure 1:
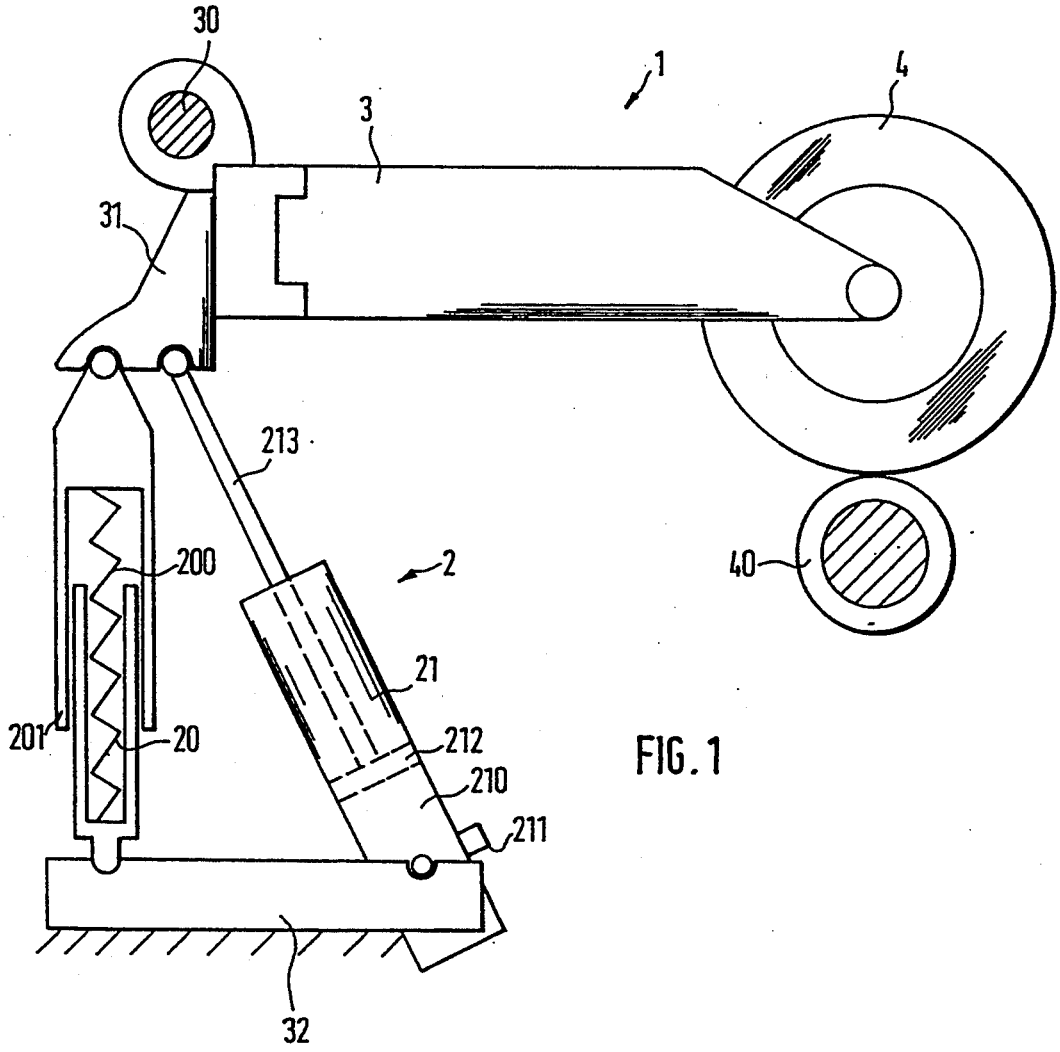
FIG. 1 shows a winding device, in a side view.

The control device 2 of FIG. 1 consists of a pressure means 20 and a cylinder 21, both of which attach at the bobbin holder 3. The bobbin holder 3 can be swivelled around an axis 30 to compensate by a swivelling movement as required for the growing diameter of the bobbin as it is built up. The pressure means 20 and the cylinder 21 exert pressure on the bobbin holder 3 via a lever 31 and bear upon a support attached to the machine frame. The pressure means 20 is in this instance a spring 200 which runs in a two-part guide 201 to avoid buckling. The spring 200 is provided with pre-stress so that it exerts a torque via the lever upon the bobbin holder 3 in such manner that the latter is pressed in the direction of the drive roller. This causes the bobbin 4 to be pressed upon the drive roller 40, in addition to the force of its own weight. As the bobbin continues to grow, the bobbin holder is swivelled around its axis 30, so that the assembly of lever 31 and pressure means 20 is brought into an extended position so that no more torque is exerted upon bobbin holder 3. In this position the contact pressure of the bobbin 4 against the drive roller 40 is produced solely by the weight of the bobbin and bobbin holder. As the bobbin continues to be built up, the pressure means 20 exerts a torque upon bobbin holder 3 in such a manner that now a force is exerted upon the bobbin holder 3, acting in opposition to the bobbin's own weight. Suitable lengths of lever 31 and a geometrical arrangement of the pressure means as well as the force exerted by the pressure means make it possible for the contact pressure of the bobbin 4 on the drive roller 40 to remain nearly constant at all times during bobbin build-up or to take a different, desired course.

Figure 2:
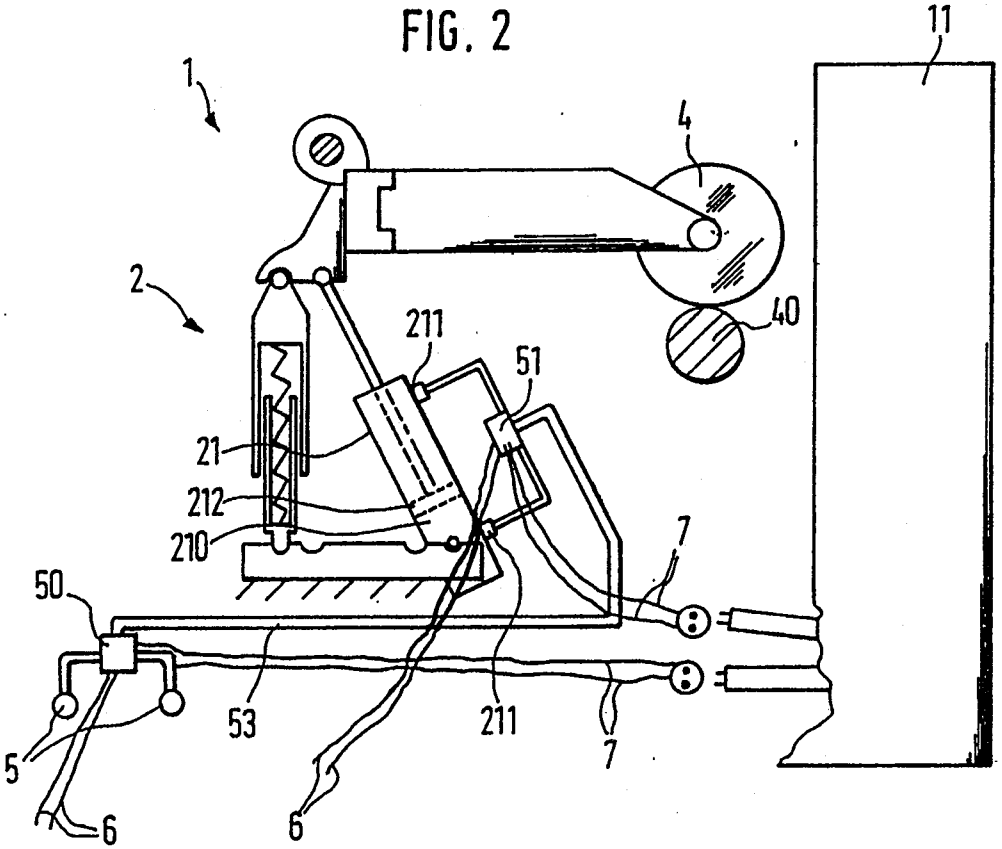
FIG. 2 shows a side view of a winding device with a control device according to the invention in which the piston of the cylinder can be subjected to pressure on both sides.

In the embodiment of FIG. 1 the pressure means 20 is combined inventively with a cylinder 21 in such a manner that the cylinder 21 exerts a force upon lever 31, said force pressing the bobbin in direction of its drive roller during the entire build-up. This is achieved thanks to suitable lever relationships. When a pressure medium acts upon the cylinder 21 a torque with a constant direction of rotation is exerted during the entire bobbin build-up, by contrast to what occurs with pressure means 20. In the shown embodiment, a cylinder with a piston 212 is shown which can be subjected to pressure only on one side via cylinder chamber 210. The cylinder chamber 210 is connected via connection 211 to a supply circuit 5 (FIG. 2). The pressure in the cylinder chamber 210 causes the piston 212 to exert its force via its piston rod 213 upon lever 31, causing the bobbin 4 to be pressed in direction of its drive roller 40. In the present embodiment a further increase of the contact pressure of roller 4 is achieved therefore through the loading of cylinder 2. The increase is thus added to a basic setting of the contact pressure which is produced by the pressure means 20. Through the combination of these two elements affecting the contact pressure of bobbin 4, a precise adjustment of bobbin contact pressure can be achieved and its applicable advantages can be utilized. The pressure means 20 allows for a pre-setting of the contact pressure of the bobbin by means of a simple, inexpensive and space-saving element which is however very inflexible by itself and would either have to be placed differently in its support or in which the pre-stress of a spring 200 would have to be modified for an adjustment, of the contact pressure. By using a cylinder 2, the latter's advantage of wide-rangeforce adjustability can be utilized without having to deal with the control devices used to change the pressure during bobbin build-up which were needed in the past whenever cylinders were used to control the bobbin contact pressure. Thus the cylinder 21 can be subjected to a fixed predetermined pressure which can be kept constant during the entire bobbin build-up. A pressure regulating device which is controlled as a function of bobbin build-up is no longer necessary.

In an advantageous further development, the control device 2 in FIG. 2 is provided with a cylinder 21, the piston 212 of which can be loaded on both sides by pressure media. For this purpose cylinder 21 is equipped with two connections 211 for the arrival of the pressure medium. Thereby, cylinder 21 can be used optionally either to increase the contact pressure of bobbin 4 during the entire bobbin build-up, or, with reversed load of piston 212, to lower the contact pressure of bobbin 4 during the entire bobbin build-up. Pressure media is provided via supply circuits 5 for the loading of piston 212. Two supply circuits 5 are assigned to the winding device 1 of FIG. 2. They convey pressure media with different pressure levels. The cylinder 21 can be connected selectively to one or the other supply circuits 5 via a solenoid valve 50. The selection of the side of piston 212 of cylinder 21 which is to be loaded with pressure can be controlled through a second solenoid valve 51. Each valve is connected via electrical control circuits 6 to the control unit of the machine (not shown). The control unit of the machine can connect each individual winding station via solenoid valve 50, either to the pressure of one or of the other supply circuit 5. The control unit of the machine determines via the magnetic valve 51 whether contact pressure should be increased, lowered or should not be influenced at all, this being possible also individually for each winding station of the machine. At the same time, the two solenoid valves 50 and 51 can also be connected via a control circuit 7 to an operating and servicing carriage 11. Thereby the appropriate application of suitable pressure to the piston can be controlled from the service carriage so that high bobbin pressure may be applied, for example, when the bobbin must be accelerated rapidly during piecing of the yarn. If the bobbin is to be pressed against the drive roller 40 with a maximum contact pressure, for example, valve 50 is switched so that it connects piston 212 to the supply circuit 5 carrying the higher pressure, and valve 51 so that the piston 212 is subjected to pressure via cylinder chamber 210. Following the intervention by the service carriage 11 in controlling the winding device, the valves 50 and 51 are moved again back into their starting positions. Appropriate measures also make it possible to design the device so that the solenoid valves can be changed over manually. It is however also possible for the valves 50 and 51 to be actuated solely by the control unit of the machine. In that case the service carriage 11 must communicate with the control unit.

Figure 3:
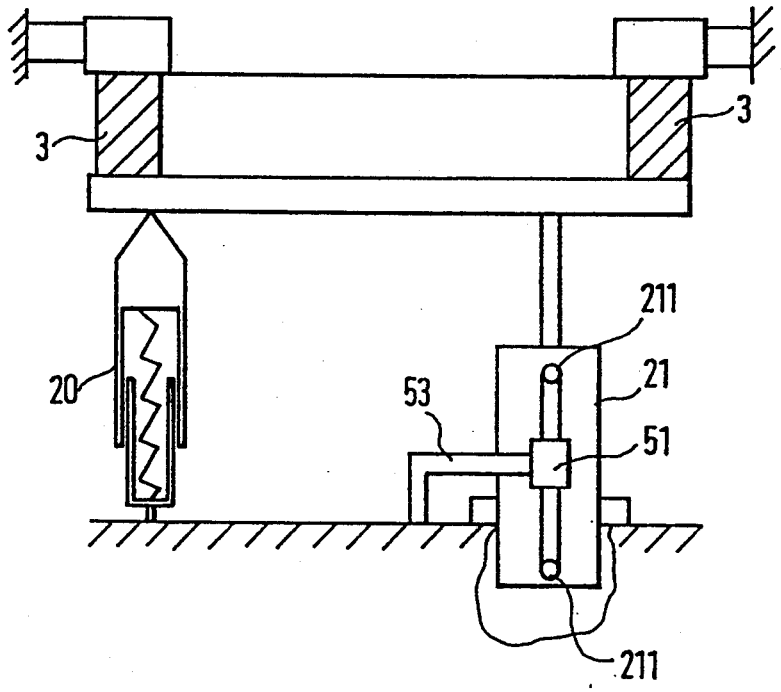
FIG. 3 shows a front view of the winding arrangement of FIG. 1, partly in a section.

FIG. 3 shows the front view of the winding device of FIG. 1, whereby the arms of the bobbin holder 3 which carry the bobbin are shown in a section. FIG. 3 clearly shows that the same plane as pressure means 20 and cylinder 21 need not be placed in the same plane. In FIG. 3 the pressure means 20 takes effect closer to the left arm of the bobbin holder 3, while cylinder 21 takes effect closer to the other arm of the bobbin holder. Cylinder 21 is provided on its cylinder side with a magnetic valve 51 which is connected over short circuits to the connections 211. The magnetic valve 51 is connected via circuit 53 to supply circuit 5 which is shown in FIG. 2.

It will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

We claim:

1. A winding device for making a bobbin yarn package, the bobbin being disposed on a bobbin holder and driven through contact pressure with a drive roller, comprising:

a first pressure mechanism connected to the bobbin holder through a lever, said first pressure mechanism disposed to initially exert torque upon the bobbin holder which increases contact pressure between the surface of said bobbin yarn package and the drive roller, and to exert opposite torque so as to decrease contact pressure between the surface of the bobbin yarn package and the drive roller as the bobbin yarn package is built up; and a piston and cylinder device connected to said bobbin holder, said piston and cylinder device connected to a constant pressure source and connected to said bobbin holder so as to exert a single directional torque upon the bobbin holder during formation of said bobbin yarn package so as to increase contact pressure between the surface of the bobbin yarn package and the drive roller.

2. The winding device as in claim 1, wherein said first pressure mechanism comprises a spring device, said spring device being pre-stressed so as to apply an initial maximum torque upon the bobbin holder.

3. The winding device as in claim 1, wherein said piston and cylinder device exerts a single directional torque upon the bobbin holder so as to decrease contact pressure between the surface of the bobbin yarn package and the drive roller.

4. The winding mechanism as in claim 1, further comprising a first pressure supply circuit operably connectable to said piston and cylinder device for supplying said piston and cylinder device with a predetermined pressurized medium.

5. The winding mechanism as in claim 4, further comprising a second pressure supply circuit operably connectable to said piston and cylinder device, and a controllable switchable valve disposed to connect said piston and cylinder device to either of said first or second pressure supply circuits.

6. The winding mechanism as in claim 5, wherein said first and second supply circuits supply pressurized mediums of different pressure.

7. The winding mechanism as in claim 4, wherein said first supply circuit is configured to supply said pressurized medium at a relatively constant preselected pressure.

* * * * *